US011121481B2

(12) United States Patent
Chiarelli

(10) Patent No.: US 11,121,481 B2
(45) Date of Patent: Sep. 14, 2021

(54) HIGH CONTACT DENSITY ELECTRICAL CONNECTOR

(71) Applicant: TE Connectivity Italia Distribution S.r.l., Collegno (IT)

(72) Inventor: Davide Chiarelli, Rivoli (IT)

(73) Assignee: TE Connectivity Italia Distribution S.r.l., Collegno (IT)

( * ) Notice: Subject to any disclaimer, the term of this patent is extended or adjusted under 35 U.S.C. 154(b) by 0 days.

(21) Appl. No.: 16/718,933

(22) Filed: Dec. 18, 2019

(65) Prior Publication Data

US 2020/0194908 A1 Jun. 18, 2020

(30) Foreign Application Priority Data

Dec. 18, 2018 (IT) ..... 102018000020179

(51) Int. Cl.
*H01R 4/48* (2006.01)
*H01R 4/2454* (2018.01)
*H01R 12/72* (2011.01)

(52) U.S. Cl.
CPC ..... *H01R 4/48* (2013.01); *H01R 4/2454* (2013.01); *H01R 12/721* (2013.01)

(58) Field of Classification Search
CPC ..... H01R 12/675; H01R 12/00; H01R 12/71; H01R 12/714; H01R 13/514; H01R 13/518; H01R 13/112; H01R 13/506; H01R 23/6806; H01R 23/6893; H01R 23/70; H01R 4/2454; H01R 4/2429; H01R 12/721; H01R 4/48
USPC ..... 439/387, 389, 395, 397, 398, 404, 443, 439/409, 410, 402, 701, 717, 630, 260, 439/59, 108, 259
See application file for complete search history.

(56) References Cited

U.S. PATENT DOCUMENTS 6,875,044 B1 * 4/2005 Lee ..... H01R 4/2433 439/404
8,834,190 B2 * 9/2014 Ngo ..... H01R 12/7023 439/328
9,203,165 B2 * 12/2015 Farole ..... H01R 12/721
2012/0149233 A1 * 6/2012 Hsueh ..... H01R 4/2454 439/395
2013/0040483 A1 2/2013 Ngo et al.
2015/0011113 A1 1/2015 Farole

FOREIGN PATENT DOCUMENTS

AT 320052 9/1971
GB 1188045 A 4/1970

OTHER PUBLICATIONS

European Patent Office Communication, dated Apr. 20, 2020, 7 pages.
Italian Search Report, dated Aug. 26, 2019, 16 pages.

* cited by examiner

*Primary Examiner* — Gary F Paumen
(74) *Attorney, Agent, or Firm* — Barley Snyder

(57) ABSTRACT

An electrical connector for connecting a pair of leads to a double-sided printed circuit board includes a housing having a receiving slot receiving the double-sided printed circuit board and a lead insertion chamber, and a pair of contact springs disposed on opposite sides of the receiving slot and electrically insulated from each other. The contact springs extend into the lead insertion chamber. Each contact spring has a lead contact for connection to a different lead of the pair of leads.

19 Claims, 3 Drawing Sheets

HIGH CONTACT DENSITY ELECTRICAL CONNECTOR

CROSS-REFERENCE TO RELATED APPLICATION

This application claims the benefit of the filing date under 35 U.S.C. § 119(a)-(d) of Italian Patent Application No. 102018000020179, filed on Dec. 18, 2018.

FIELD OF THE INVENTION

The present invention relates to an electrical connector and, more particularly, to a high-density electrical connector.

BACKGROUND

Electrical connectors are ubiquitous today. They are used in electronic systems, which require a variety of electrical connectors for establishing many different types of electrical interconnections, for example a cable to circuit board. With the prevalence of miniaturized electronics, such as cell phones, personal digital assistants, and in particular signal connectors in automobiles, which are put under tight size and weight constraints, there is a great need for a high-density electrical connector.

SUMMARY

An electrical connector for connecting a pair of leads to a double-sided printed circuit board includes a housing having a receiving slot receiving the double-sided printed circuit board and a lead insertion chamber, and a pair of contact springs disposed on opposite sides of the receiving slot and electrically insulated from each other. The contact springs extend into the lead insertion chamber. Each contact spring has a lead contact for connection to a different lead of the pair of leads.

BRIEF DESCRIPTION OF THE DRAWINGS

The invention will now be described by way of example with reference to the accompanying Figures, of which.

DETAILED DESCRIPTION OF THE EMBODIMENT(S)

Figure 2:
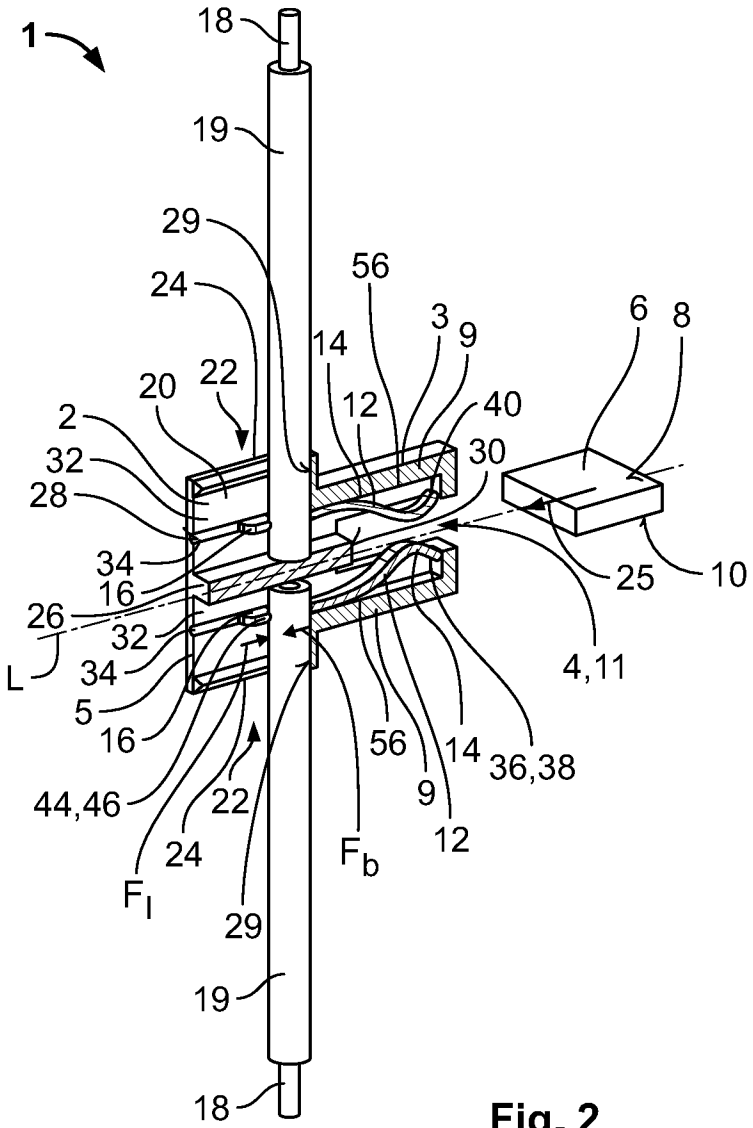
FIG. 2 is a sectional perspective view of the electrical connector of FIG. 1.

In the following, the electrical connector according to the invention is explained in greater detail with reference to the accompanying drawings, in which exemplary embodiments are shown. In the figures, the same reference numerals are used for elements which correspond to one another in terms of their function and/or structure.

Elements shown in the drawings can be omitted if the technical effects of these elements are not needed for a particular application, and vice versa: i.e. elements that are not shown or described with reference to the figures but are described above can be added if the technical effect of those particular elements is advantageous in a specific application.

Figure 1:
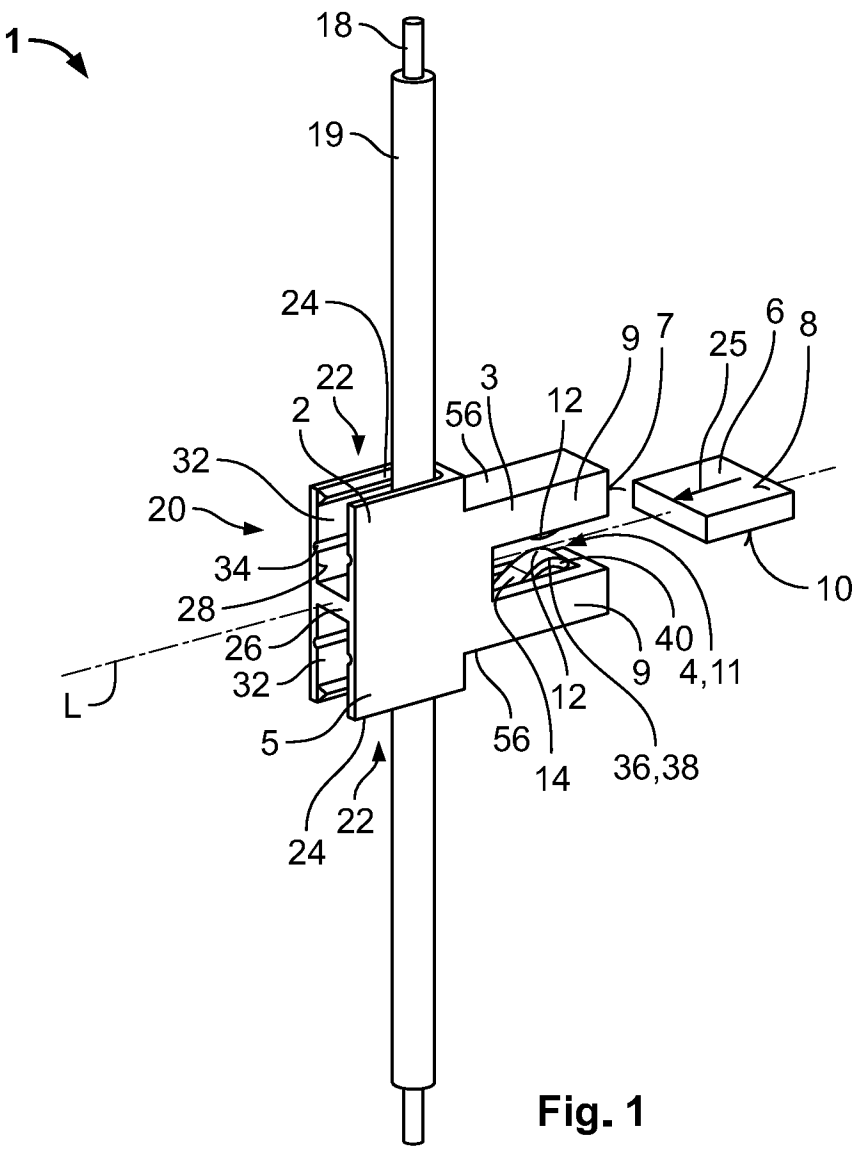
FIG. 1 is a perspective view of an electrical connector according to an embodiment.

An electrical connector 1 according to an embodiment, as shown in FIGS. 1 and 2, comprises a T-shaped housing 2 with a longitudinal beam section 3 and a crossbeam section 5. The longitudinal beam section 3 has a receiving slot 4. The receiving slot 4 is open at an end 7 facing away from the crossbeam section 5 and perpendicular to the crossbeam 5, so that a printed circuit board 6, also referred to as a PCB, can be inserted into the receiving slot 4. The longitudinal beam section 3 has a pair of legs 9 which are distanced from one another, and a gap 11 between the legs 9 which forms the receiving slot 4.

In the embodiment shown in FIGS. 1 and 2, the printed circuit board 6 is a double-sided printed circuit board 6. A top surface 8 and a bottom surface 10 of the printed circuit board 6 both have an electrical conductor.

As shown in FIGS. 1 and 2, a pair of contact springs 12 is mounted in the housing 2. The contact springs 12 have a spring section 14 for contacting the surface 8, 10 of the printed circuit board 6. The contact springs 12, in particular the spring section 14 of the contact springs 12, are arranged on opposite sides of the receiving slot 4.

The contact springs 12, as shown in FIG. 2, each have a lead contact 16 for connection to a different lead 18 of a pair of leads 18. The contact springs 12 are arranged in a lead insertion chamber 20 of the housing 2 with lead openings 22 of the lead insertion chamber 20 arranged on opposing front faces 24 of the crossbeam section 5. Each of the lead openings 22 receives insertion of a different lead 18. Hence, the electrical connector 1 according to this exemplary embodiment is a T-shaped connector, wherein the leads 18 protrude from opposing sides of the lead insertion chamber 16 and are arranged perpendicular to an insertion direction 25 of the PCB 6 into the receiving slot 4. Each of the leads 18 is surrounded by an insulation 19 in order to prevent a short circuit. In another embodiment, the lead openings 22 can be arranged on a same side of the lead insertion chamber 20.

In an embodiment, the electrical connector 1 has a plurality of rows of contact springs 12 on each surface 8, 10 of the printed circuit board 6, with the contact springs 12 each electrically insulated from each other. Therefore, multiple leads 18 can be connected to each side of the double-sided PCB 6. A pitch distance between each contact spring 12 in a row of contact springs, in an embodiment, is about 2.5 mm.

As shown in FIGS. 1 and 2, the housing 2 has a separation wall 26 extending along a longitudinal axis L arranged parallel to the insertion direction 25 from an end face 28 of the crossbeam section 5 facing away from the longitudinal beam section 3 to the receiving slot 4. The separation wall 26 has an abutting surface 30 that limits the receiving slot 4 in the insertion direction 25 and abuts the PCB 6 when the PCB 6 is fully inserted into the receiving slot 4. The separation wall 26 splits the lead insertion chamber 20 into two compartments 32. Each contact spring 12 is mounted in one of the two compartments 32; the lead contacts 16 are each mounted in different compartments 32 electrically insulating them from each other. The compartments 32 may be structurally symmetrical, or one compartment 32 may extend further in a direction away from the receiving slot 4 than the other, so that the leads 18 may easily be inserted into each compartment 32 from the same side.

The separation wall 26, in an embodiment, may be formed integrally with the housing 2, in order to form, for example, an injection-molded housing that can easily and cheaply be produced in mass-scale. The housing 2 and the separation wall 26 may be formed of an electrically insulating material preventing a short circuit. The separation wall 26, in an embodiment, may be formed of an electrically insulating material, so that a short circuit between the different leads 18 can be avoided. In another embodiment, the separation wall 26 and the housing 2 may be separate parts, wherein the separation wall 26 can be fixed, albeit removable, in the housing 2, so that the lead insertion chamber 20 can be split into two compartments 32 or left as a single compartment to permit a same lead 18 to be connected to contact springs 12 at the top surface 8 and bottom surface 10 of the printed circuit board 6.

As shown in FIGS. 1 and 2, the end face 28 is open so that the leads 18 can be inserted from the end face 28 and/or the lead opening 22, and a push-down tool (not shown) can be used to push the lead 18 towards the corresponding lead contact 16. The push-down tool may be formed as a push-down block that closes the end face 28 of the housing 2 and can press the lead 18 towards the lead contact 16 to form the connection and further protect the interior of the housing 2 from dust or any other outer influence. The push-down block may be a separate part of the housing 2, which can be slidably fixed to the housing 2 at an end of the lead insertion chamber 20, closing an opening.

A stop surface 29, shown in FIG. 2, can be formed by a wall of the crossbeam section 5 opposite the end face 28. The stop surface 29 abuts the leads 18 when they are pushed to the lead contact 16 to make the connection. The leads 18 therefore can be pushed too far into the housing 2, preventing damage to the leads 18.

The housing 2, as shown in FIGS. 1 and 2, has a pair of opposing grooves 34 extending parallel to the longitudinal axis L from the end face 28 in each of the two compartments 32, in order to guide the insertion of the contact springs 12 into the housing 2 and for fixing the contact springs 12 in the housing 2. The grooves 34 each form a pocket in which a latch of the contact spring 12 can snap in and lock the contact spring 12 in the housing 2.

Figure 3:
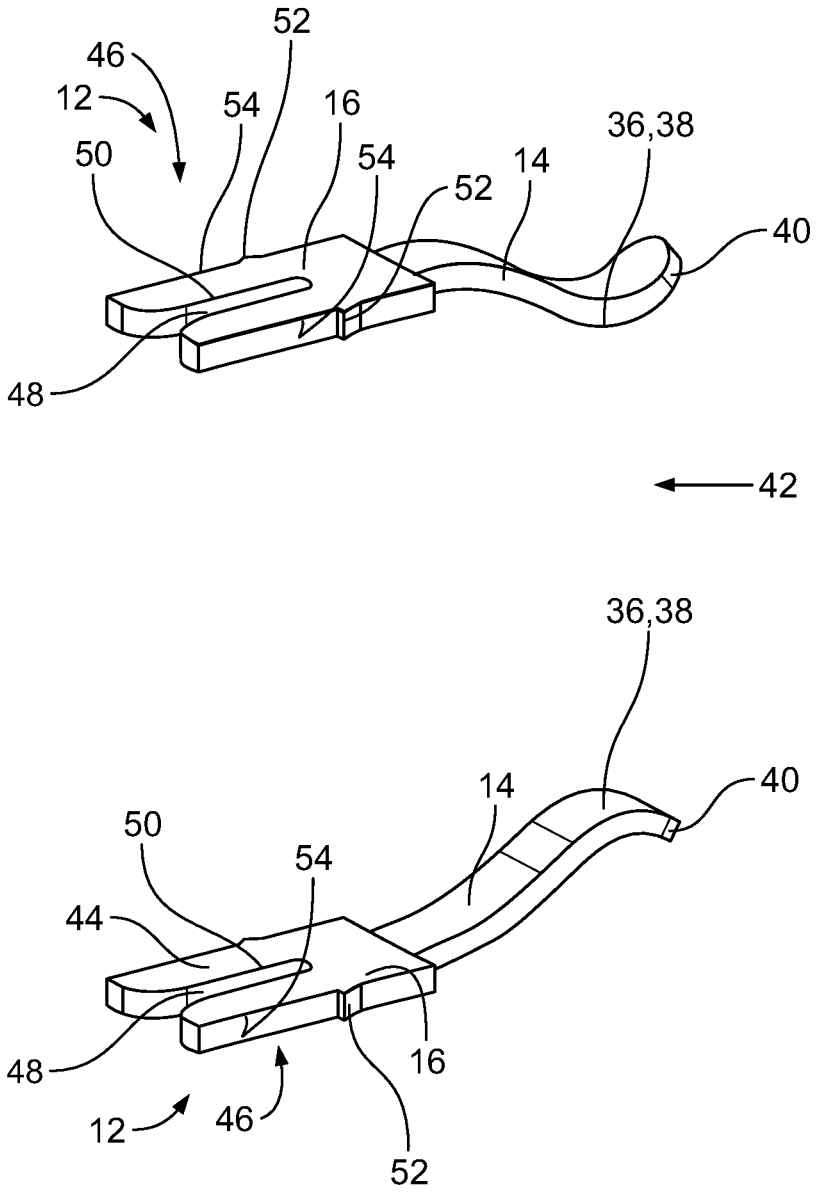
FIG. 3 is a perspective view of a pair of contact springs of the electrical connector of FIG. 1.

The contact springs 12, as shown in FIG. 3, have the spring section 14 with a curved shape, the spring section 14 of opposing contact springs 21 are bent towards each other. A contact area 36 is formed by a peak 38 of the spring section 14 for contacting the top surface 8 and bottom surface 10 of the PCB 6. The spring sections 14 each have an extremity 40, which are bent away from one another forming a funnel 42 for readily receiving the PCB 6.

From the spring section 14, the lead contact 16 extends in the form of a flat plate 44. As shown in FIG. 2, that has a wider cross-section than the spring section 14. The flat plate 44 permits mounting of the contact spring 12 in the housing 2 without affecting the movement of the spring section 14. The lead contact 16 is formed as an insulation displacement contact 46 with a short open-ended slot 48 containing sharp metal blades 50 on each side of the slot 48, in order to cut through the lead's insulation 19 and make electrical contact with the lead 18. Therefore, the need of stripping the lead 18 before connecting may be bypassed. The lead 18 can cold-weld to the blades 50, making a reliable gas-tight connection. The blades 50 may be formed of a low strength metal that is easily deformable at low pressure such as copper and its alloys or aluminum and its alloys.

Chamfered locking latches 52 project from opposing sides 54 of the lead contact 16, as shown in FIG. 3, that engage a notch formed in the groove 34 of the housing 2 for securely mounting and positioning the contact springs 12 in the housing 2. As shown in FIG. 2, the contact springs 12 are arranged in the housing 2 in such a manner that the spring section 14 at least partially rests on a side wall 56 of the longitudinal beam section 3 of the housing 2, so that the housing 2 mechanically supports the contact spring 12.

Figure 4:
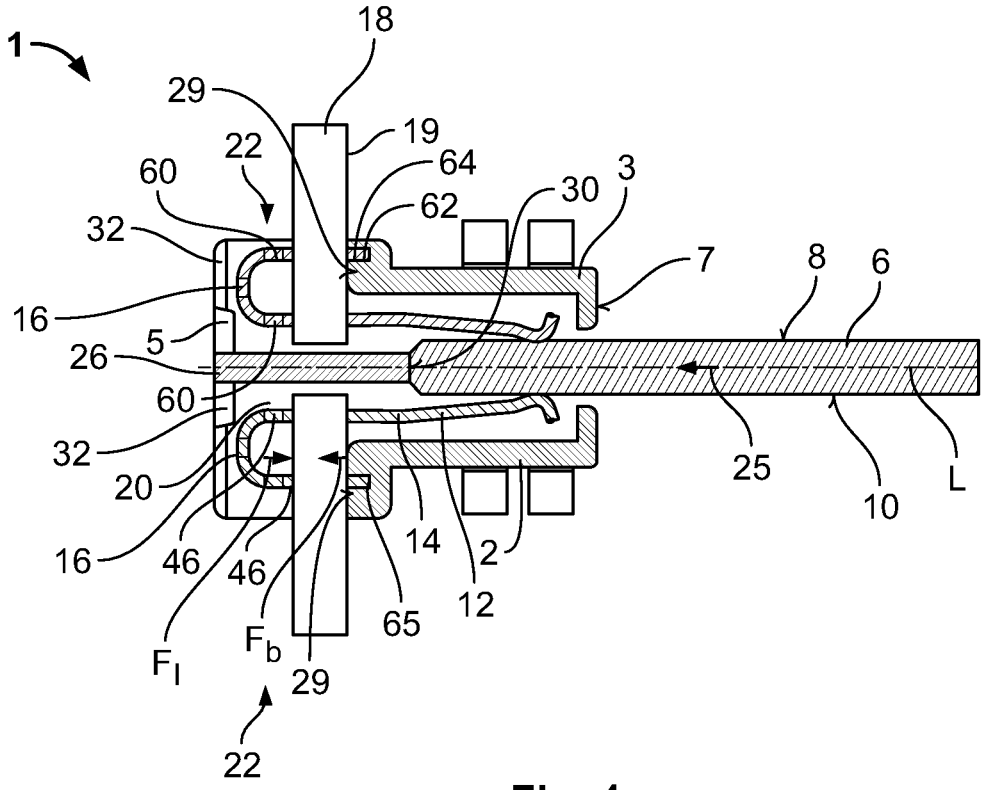
FIG. 4 is a sectional side view of an electrical connector according to another embodiment.

An electrical connector 1 according to another embodiment is shown in FIG. 4. In comparison to the first embodiment shown in FIGS. 1 and 2, the lead contact 16 of the contact springs 12 in the embodiment shown in FIG. 4 are bent away from the opposing contact spring 12 at about 180° to form an essentially U-shaped lead contact 16. Each arm 60 of the lead contact 16 has an insulation displacement contact 46 as described with reference to FIG. 2, so that the lead 18 can be contacted by the lead contact 16 at two positions, further improving the contact reliability of the electrical connector 1. In another embodiment, the U-shaped lead contact 16 may be arranged such that the arms 60 are arranged essentially perpendicular to the longitudinal axis L and the U-shaped lead contacts 16 are opened towards each other.

As shown in FIG. 4, a free tip 62 of the lead contact 16 may project into a recess 64 of the housing 2 for securing and accurately positioning the contact spring 12 in the housing 2. The housing 2 can mechanically support the contact spring 12 in order to create a predetermined contact force for contacting the PCB 6. The stop surface 22, in particular the recess 64, can further function as a bearing 65 creating a back-pressure Fb for the contact spring 12 balancing an insertion force $F_1$ of the lead 18 to the lead contact 16.

In another embodiment, the leads 18 may be arranged parallel to one another and protrude from a same side of the housing 2. The leads 18 may be particularly arranged essentially parallel to the longitudinal axis L and protrude from the end face 28 of the housing 2.

Figure 5:
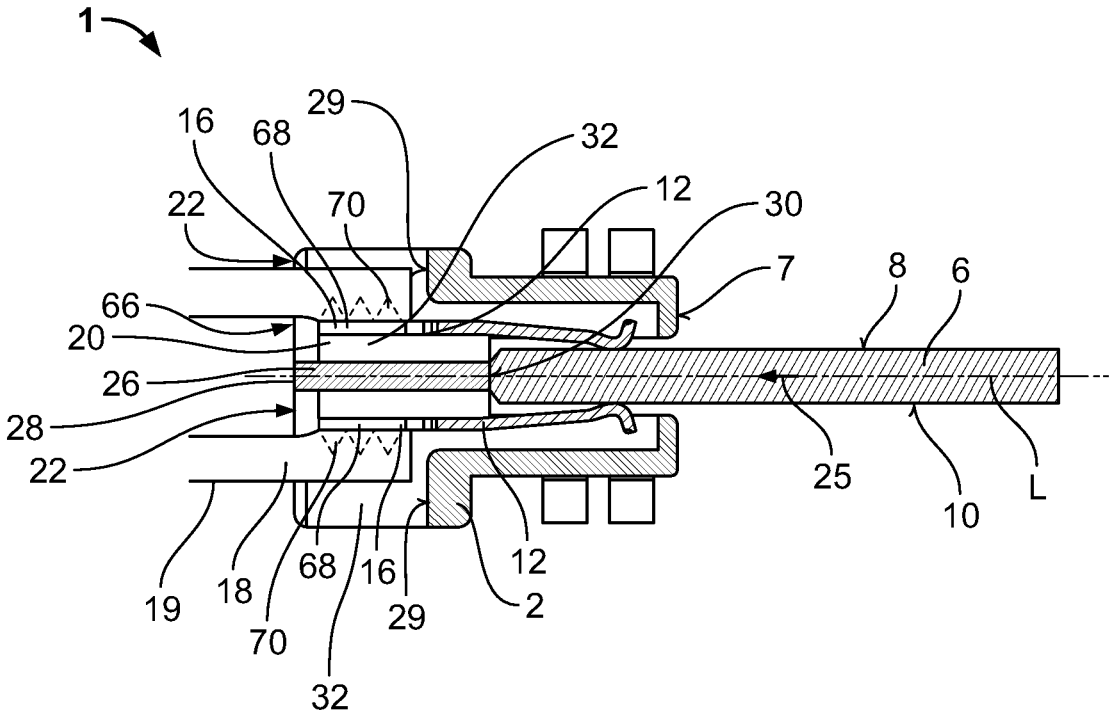
FIG. 5 is a sectional side view of an electrical connector according to another embodiment.

An electrical connector 1 according to another embodiment is shown in FIG. 5. In contrast to the first and second exemplary embodiments, the electrical connector 1 in the embodiment of FIG. 5 is a parallel connector, meaning that the leads 18 are arranged essentially parallel to the PCB 6. The leads 18 protrude from the lead openings 22 at the end face 28 facing away from the receiving slot 4. The lead openings 22 are separated from each other by the separation wall 26, so that a channel 66 for each lead 18 is formed.

The lead contact 16, in the embodiment of FIG. 5, is formed as an insulation piercing contact 68, which is a type of an insulation displacement contact 46. The lead contact 16 has a plurality of conductive spikes 70, which are capable of penetrating through the insulation 19 of the lead 18 in order to establish a cold-welded connection between the lead 18 and the contact spring 12. The spikes 70 extend perpendicular to the longitudinal axis L, and the spikes 70 of the different contact springs 12 project in opposite directions. The stop surface 29 may limit the depth in which the lead 18 can be inserted into the lead insertion chamber 20.

The electrical connector 1 permits termination of two different electric circuits on a double-sided PCB 6 at a single position. One circuit can run from a first lead 18 and the top surface 8 of the PCB 6 and the other circuit can run from a second lead 18 that is different from the first lead 18 at the bottom surface 10 of the PCB 6. Therefore, it is possible to double the contact density in comparison to well-known electrical connectors that have a single spring contact connected to the top and bottom surface 8, 10 of the PCB 6. The connection between the leads 18 and the lead contacts 16 can be further protected from the surroundings by having the lead contacts 16 arranged in the housing 2.

The embodiments described herein are exemplary and other embodiments are also within the scope of this application. For example, the electrical connector 1 can comprise multiple pairs of contact springs 12, wherein one contact spring 12 of the pair is arranged in a first row and the other contact spring 12 is arranged in a second row on opposing sides of the receiving slot 4.

What is claimed is:

1. An electrical connector for connecting a pair of leads to a double-sided printed circuit board, comprising:

a housing having a receiving slot receiving the double-sided printed circuit board and a lead insertion chamber;

a pair of leads received within the lead insert chamber; and a pair of contact springs disposed on opposite sides of the receiving slot and electrically insulated from each other, the contact springs extend into the lead insertion chamber, each contact spring has a lead contact for connection to a different lead of the pair of leads, the lead insertion chamber is split into a pair of compartments separated from one another by a separation wall disposed between the pair of leads in a direction parallel to an insertion direction of the double-sided printed circuit board, the separation wall is a stop limiting the receiving slot.

2. The electrical connector of claim 1, wherein the lead contact of each contact spring is disposed in the lead insertion chamber.

3. The electrical connector of claim 1, wherein each contact spring forms a cold welded connection to the different lead.

4. The electrical connector of claim 1, wherein the lead contact is an insulation displacement contact.

5. The electrical connector of claim 1, wherein the lead contact is an insulation piercing contact.

6. The electrical connector of claim 1, wherein at least one of the contact springs is mounted in each of the compartments.

7. The electrical connector of claim 1, wherein the separation wall extends from a lead opening of the lead insertion chamber to the receiving slot.

8. The electrical connector of claim 7, wherein the leads are inserted into the lead insertion chamber through the lead opening.

9. The electrical connector of claim 7, wherein the separation wall forms a channel for each of the leads.

10. The electrical connector of claim 7, wherein the lead insertion chamber has at least two lead openings, each of the lead openings opens into one of the compartments.

11. The electrical connector of claim 10, wherein the lead openings open in opposite directions.

12. The electrical connector of claim 10, wherein the lead openings open in a same direction.

13. The electrical connector of claim 1, wherein each of the contact springs has a spring section with a curved shape extending from the lead contact.

14. The electrical connector of claim 13, wherein the spring section has a contact area at a peak of the spring section, the contact area electrically contacting a surface of the double-sided printed circuit board.

15. The electrical connector of claim 1, wherein the lead contact of each of the contact springs is a flat plate.

16. The electrical connector of claim 4, wherein the lead contact of each of the contact springs has a U-shape.

17. The electrical connector of claim 16, wherein each of a plurality of arms of the lead contact have the insulation displacement contact.

18. The electrical connector of claim 16, wherein a free tip of the lead contact projects into a recess in the housing to secure the contact spring in the housing.

19. The electrical connector of claim 14, wherein the double-sided printed circuit board abuts against an abutting surface of the separation wall when the double-sided printed circuit board is fully inserted in the insertion direction, the abutting surface is disposed between the contact areas of the contact springs and the pair of leads along the insertion direction.

* * * * *